US009387660B2

(12) United States Patent
Rondon et al.

(10) Patent No.: US 9,387,660 B2
(45) Date of Patent: Jul. 12, 2016

(54) ABLATION-TYPE LITHOGRAPHIC PRINTING MEMBERS HAVING IMPROVED SHELF LIFE AND RELATED METHODS

(75) Inventors: Sonia Rondon, Nashua, NH (US); Kevin Ray, Windham, NH (US)

(73) Assignee: Presstek, LLC, Hudson, NH (US)

( * ) Notice: Subject to any disclaimer, the term of this patent is extended or adjusted under 35 U.S.C. 154(b) by 407 days.

(21) Appl. No.: 13/591,946

(22) Filed: Aug. 22, 2012

(65) Prior Publication Data

US 2012/0312183 A1 Dec. 13, 2012

Related U.S. Application Data

(63) Continuation-in-part of application No. 13/295,300, filed on Nov. 14, 2011, which is a continuation-in-part of application No. 13/109,651, filed on May 17, 2011.

(51) Int. Cl.
*B41M 1/08* (2006.01)
*B41C 1/10* (2006.01)

(52) U.S. Cl.
CPC ..... *B41C 1/1033* (2013.01); *B41M 1/08* (2013.01); *B41C 2210/04* (2013.01)

(58) Field of Classification Search
None
See application file for complete search history.

(56) References Cited

U.S. PATENT DOCUMENTS

| | | | |
|---|---|---|---|
| 5,339,737 | A | 8/1994 | Lewis et al. |
| 6,194,122 | B1 | 2/2001 | Ichikawa et al. |
| 6,344,306 | B1 | 2/2002 | Fujiyoshi et al. |
| 6,576,399 | B1 | 6/2003 | Gries et al. |
| 8,967,043 | B2 | 3/2015 | Rondon et al. |
| 2001/0026902 | A1 | 10/2001 | Hirano et al. |
| 2004/0005514 | A1 | 1/2004 | Saraiya et al. |
| 2004/0224256 | A1 | 11/2004 | Figov et al. |
| 2009/0253069 | A1 | 10/2009 | Melamed et al. |
| 2009/0305162 | A1 | 12/2009 | Melamed et al. |
| 2012/0055363 | A1 | 3/2012 | Danzinger et al. |

(Continued)

FOREIGN PATENT DOCUMENTS

| | | |
|---|---|---|
| EP | 1788431 A2 | 5/2007 |
| EP | 2425985 | 3/2012 |

(Continued)

OTHER PUBLICATIONS

Crosslinkers, Allnex A., "Amino Crosslinkers", Allnex CYMEL Product Guide, 2014, pp. 1-19.

(Continued)

*Primary Examiner* — Joshua D Zimmerman
(74) *Attorney, Agent, or Firm* — Morgan, Lewis & Bockius LLP

(57) ABSTRACT

Ablation-type printing plates having increased shelf-life are produced using a melamine resin free of water prior to use. A representative production sequence includes providing a substrate having an oleophilic surface; coating, over the substrate, an oleophilic resin composition having (A) a resin phase consisting essentially of a melamine resin substantially free of water and a resole resin, the resole resin being present in an amount ranging from 0% to 28% by weight of dry film, (B) a near-IR absorber dispersed within the resin phase, and (C) a sulfonic acid catalyst dispersed within the resin phase and being present in an amount ranging from 0.7% to 1.6% by weight of dry film; curing the resin composition to produce a dry film; following resin curing, coating an oleophobic polymer composition over the cured resin composition; and curing the oleophobic polymer composition.

16 Claims, 1 Drawing Sheet

(56) References Cited

U.S. PATENT DOCUMENTS

| | | | |
|---|---|---|---|
| 2012/0291643 | A1 | 11/2012 | Rondon et al. |
| 2012/0291644 | A1 | 11/2012 | Rondon et al. |
| 2012/0291645 | A1 | 11/2012 | Rondon et al. |

FOREIGN PATENT DOCUMENTS

| | | | |
|---|---|---|---|
| EP | 2709846 | A1 | 3/2014 |
| WO | 2012/158318 | A1 | 11/2012 |
| WO | 2014/031828 | A1 | 2/2014 |

OTHER PUBLICATIONS

Porwal, Harshad, "Cytec Cymel Resins", CYTEC Cymel Product Guide, 2010, pp. 1-8.

Written Opionion mailed Nov. 19, 2013 for International Application No. PCT/US2012/034879 (6 pages).

International Search Report and Written Opinion Jul. 25, 2012 for PCT/US2012/034879 mailed (11 pages).

Holmberg, K. "*Low Temperature Acid-Catalyzed Curing of Melamine Resin Systems*" Polymers Bulletin 11, 81-84 (1984).

PCT International Patent Application No. PCT/US2012/034879, International Preliminary Report on Patentability mailed Nov. 28, 2013, 8 pages.

PCT International Patent Application No. PCT/US2013/056139, International Preliminary Report on Patentability mailed Mar. 5, 2015, 8 pages.

PCT International Patent Application No. PCT/US2013/056139, International Search Report and Written Opinion mailed Jan. 20, 2014, 10 pages.

"Allnex Product Guide", online available at <www.allnex.com>, retrieved on Jun. 2, 2014, pp. 1-20.

ABLATION-TYPE LITHOGRAPHIC PRINTING MEMBERS HAVING IMPROVED SHELF LIFE AND RELATED METHODS

RELATED APPLICATION

This is a continuation-in-part of U.S. Ser. No. 13/295,300, filed on Nov. 14, 2011, which is itself a continuation-in-part of U.S. Ser. No. 13/109,651, filed on May 17, 2011; the entire disclosures of both of these applications are hereby incorporated by reference in their entireties.

BACKGROUND OF THE INVENTION

In offset lithography, a printable image is present on a printing member as a pattern of ink-accepting (oleophilic) and ink-rejecting (oleophobic) surface areas. Once applied to these areas, ink can be efficiently transferred to a recording medium in the imagewise pattern with substantial fidelity. Dry printing systems utilize printing members whose ink-repellent portions are sufficiently phobic to ink as to permit its direct application. In a wet lithographic system, the non-image areas are hydrophilic, and the necessary ink-repellency is provided by an initial application of a dampening fluid to the plate prior to inking. The dampening fluid prevents ink from adhering to the non-image areas, but does not affect the oleophilic character of the image areas. Ink applied uniformly to the printing member is transferred to the recording medium only in the imagewise pattern. Typically, the printing member first makes contact with a compliant intermediate surface called a blanket cylinder which, in turn, applies the image to the paper or other recording medium. In typical sheet-fed press systems, the recording medium is pinned to an impression cylinder, which brings it into contact with the blanket cylinder.

To circumvent the cumbersome photographic development, plate-mounting, and plate-registration operations that typify traditional printing technologies, practitioners have developed electronic alternatives that store the imagewise pattern in digital form and impress the pattern directly onto the plate. Plate-imaging devices amenable to computer control include various forms of lasers.

Dry plates, which utilize an oleophobic topmost layer of fluoropolymer or, more commonly, silicone (polydiorganosiloxane), exhibit excellent debris-trapping properties because the topmost layer is tough and rubbery; ablation debris generated thereunder remains confined as the silicone or fluoropolymer does not itself ablate. Where imaged, the underlying layer is destroyed or de-anchored from the topmost layer. A common three-layer plate, for example, is made ready for press use by image-wise exposure to imaging (e.g., infrared or "IR") radiation that causes ablation of all or part of the central layer, leaving the topmost layer de-anchored in the exposed areas. Subsequently, the de-anchored overlying layer and the central layer are removed (at least partially) by a post-imaging cleaning process—e.g., rubbing of the plate with or without a cleaning liquid—to reveal the third layer (typically an oleophilic polymer, such as polyester).

To be viable commercially, printing members must be able to withstand a variety of predictable environments for relatively long periods of time. Lithography is carried out on a worldwide basis in installations ranging from high-volume industrial operations to small print shops. Although traditional photosensitive plates naturally exhibited limited shelf-life as a consequence of radiation sensitivity, even ablation-type plates can degrade over time. Although they require high exposure fluences to remove an energy-absorbing layer in order to create an image, and therefore are not particularly sensitive to environmental radiation, multi-layer polymeric structures nonetheless remain vulnerable to other environmental conditions—temperature extremes, high relative humidity, and long exposure to—i.e., aging in—these environments. Most notably, aging substantially reduces the useful length of run on press. Whereas a new plate may achieve 20,000 impressions, an age-degraded plate under the same conditions will fail very early, e.g., after 1000 impressions. In a dry plate, the silicone layer falls away on-press and ink is accepted in unwanted regions of the plate. Age-degraded plates also have a tendency to scratch easily (e.g., due to the breakdown of silicone and/or its loss of adhesion to the underlayer).

Accordingly, there is a persistent need for improvements in plate shelf-life, i.e., long-term tolerance to stressful environmental conditions.

SUMMARY OF THE INVENTION

As detailed in the '651 parent application, an advantageous ablation-type plate construction comprises an oleophilic first layer, an imaging layer disposed over the first layer, and an oleophobic third layer disposed over the imaging layer. The imaging layer includes or consists essentially of a cured resin phase that itself consists essentially of a melamine resin and a resole resin, the resole resin being present in an amount ranging from 0% to 28% by weight of dry film; a near-IR absorber dispersed within the cured resin phase; and a sulfonic acid catalyst dispersed within the cured resin phase. It is found, surprisingly, that shelf-life of the plate is substantially improved if the melamine resin is free of water prior to use. Without being bound to any particular theory or mechanism, it is believed that the presence of water in the formulation of the imaging layer degrades the aging performance of the plate structure. Furthermore, catalyst levels play an indirect role in that they must be optimized for the formulation chosen; that is, it was not possible to produce plate structures with acceptable aging behavior unless the catalyst level used in the imaging layer fell within an acceptable range.

Accordingly, in a first aspect, the invention pertains to a method of making an ablation-type printing member. In various embodiments, the method comprises the steps of providing a substrate having an oleophilic surface; coating, over the substrate, an oleophilic resin composition having (A) a resin phase consisting essentially of a melamine resin substantially free of water and a resole resin, the resole resin being present in an amount ranging from 0% to 28% by weight of dry film, (B) a near-IR absorber dispersed within the resin phase, and (C) a sulfonic acid catalyst dispersed within the resin phase and being present in an amount ranging from 0.7% to 1.6% by weight of dry film; curing the resin composition to produce a dry film; following resin curing, coating an oleophobic polymer composition over the cured resin composition; and curing the oleophobic polymer composition. In some embodiments, the melamine resin is provided in an organic solvent, e.g., isobutanol. The sulfonic acid catalyst may be present in an amount ranging from 1% to 1.4% by weight of dry film. The substrate may be polymeric or metal (e.g., an aluminum sheet), or a combination.

In some embodiments, the imaging layer contains no resole resin. The near-IR absorber may consist essentially of a dye, constituting, for example, from 12% to 30% of the imaging layer by weight of dry film, and in some cases, 25% to 30% of the imaging layer by weight of dry film. The imaging layer may have a dry coating weight of approximately 0.5 g/m$^2$ to approximately 1.5 g/m$^2$. In some embodiments, the melamine resin is a methylated, low-methylol, high-imino melamine.

In a second aspect, the invention pertains to storing an ablation-type lithographic printing member under conditions that would be expected to cause sufficient performance degradation to prevent acceptable printing (i.e., ink uptake and transfer to a recording medium), and nonetheless using the plate to achieve commercially acceptable printing results. As used herein, the term "commercially acceptable results" means a print "make-ready" time (i.e., the number of preliminary impressions necessary to achieve an acceptable printed sheet) of less than 20 sheets of paper, ink placed where desired, no perceptible toning (i.e., unwanted ink in non-image regions), and the ability to achieve at least 20,000 commercially acceptable impressions.

In particular, the ablation-type printing member comprises (i) an oleophilic substrate, (ii) over and in contact with the substrate, an imaging layer comprising the cured product of an oleophilic resin composition having a resin phase consisting essentially of a melamine resin substantially free of water and a resole resin, the resole resin being present in an amount ranging from 0% to 28% by weight of dry film, a near-IR absorber dispersed within the resin phase, and a sulfonic acid catalyst dispersed within the resin phase and being present in an amount ranging from 0.7% to 1.6% by weight of dry film, and (iii) over and in contact with the imaging layer, a cured oleophobic polymer composition. In various embodiments, the method comprises the steps of storing the printing member without use for at least 24 months under conditions including a temperature ranging from 60 to 80° F. and a relative humidity of 40 to 60%; then using the printing member by exposing it to imaging radiation having a fluence of no more than 190 mJ/cm$^2$ in an imagewise pattern, the imaging radiation at least partially ablating the imaging layer where exposed; removing imaging debris from the printing member; and transferring ink to the printing member and thereafter from the printing member to a recording medium at least 500 times with commercially acceptable results. In some embodiments, the printing member is stored for at least 30 and even 36 or more months (e.g., five years). (Typical storage conditions also include conventional measures to protect printing members against sunlight and bright room light, e.g., keeping them in their original package with interleaf.)

The imaging debris may be removed with cleaning fluid, e.g., an aqueous liquid such as plain tap water. In some embodiments, the aqueous liquid comprises water and a component that eases the removal of silicone. For example, the aqueous liquid may include not more than 20% (or not more than 15%) by weight of an organic solvent, e.g., an alcohol, and the alcohol may be a glycol (e.g., propylene glycol), benzyl alcohol and/or phenoxyethanol. The aqueous liquid may comprise a surfactant. It may be heated to a temperature greater than about 80° F. The machine cleaning may be spray-on cleaning, e.g., using oscillating brush rollers.

In various embodiments, the near-IR absorber constitutes no less than 25% of the imaging layer by weight of dry film, and the melamine resin may constitute no more than 88% of the imaging layer by weight; e.g., the melamine resin may be a methylated, low-methylol, high-imino melamine, and may have a viscosity ranging from 1000 to 1600 centipoises at 23° C.

As used herein, the term "plate" or "member" refers to any type of printing member or surface capable of recording an image defined by regions exhibiting differential affinities for ink and/or fountain solution. Suitable configurations include the traditional planar or curved lithographic plates that are mounted on the plate cylinder of a printing press, but can also include seamless cylinders (e.g., the roll surface of a plate cylinder), an endless belt, or other arrangement.

"Ablation" of a layer means either rapid phase transformation (e.g., vaporization) or catastrophic thermal overload, resulting in uniform layer decomposition. Typically, decomposition products are primarily gaseous. Optimal ablation involves substantially complete thermal decomposition (or pyrolysis) with limited melting or formation of solid decomposition products.

The terms "substantially" and "approximately" mean ±10% (e.g., by weight or by volume), and in some embodiments, ±5%. The term "consists essentially of" means excluding other materials that contribute to function or structure. For example, a resin phase consisting essentially of a melamine resin and a resole resin may include other ingredients, such as a catalyst, that may perform important functions but do not constitute part of the polymer structure of the resin. Percentages refer to weight percentages unless otherwise indicated.

DESCRIPTION OF DRAWINGS

In the following description, various embodiments of the present invention are described with reference to FIGS. 1A and 1B, which show enlarged cross-sectional views of printing members according to the invention.

DETAILED DESCRIPTION

1. Printing Plates

Figure 1A:
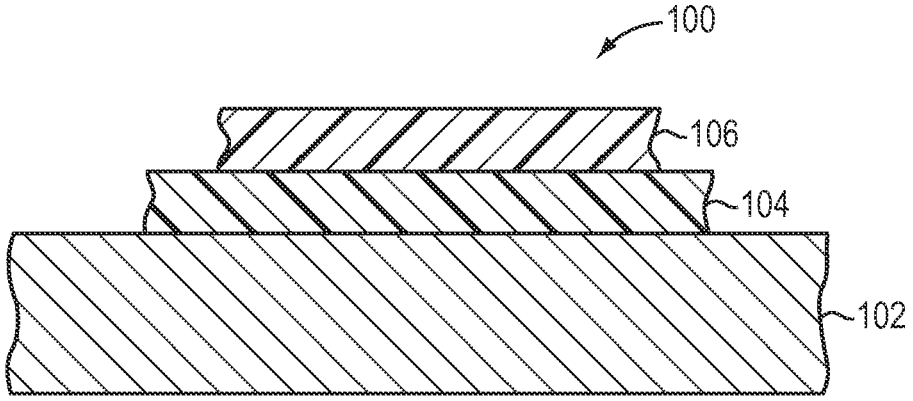

FIG. 1A illustrates a negative-working printing member 100 according to the present invention that includes a metal substrate 102, an imaging layer 104, and a topmost layer 106. Layer 104 is sensitive to imaging (generally IR) radiation as discussed below, and imaging of the printing member 100 (by exposure to IR radiation) results in imagewise ablation of the layer 104. The resulting de-anchorage of topmost layer 106 facilitates its removal by rubbing or simply as a result of contact during the print "make ready" process. Preferably, the ablation debris of layer 104 is chemically compatible with water in the sense of being acted upon, and removed by, an aqueous liquid following imaging. Substrate 102 (or a layer thereover) exhibits a lithographic affinity opposite that of topmost layer 106. Consequently, ablation of layer 104, followed by imagewise removal of the layer 106 to reveal an underlying layer or the substrate 102, results in a lithographic image.

Most of the films used in the present invention are "continuous" in the sense that the underlying surface is completely covered with a uniform layer of the deposited material. Each of these layers and their functions is described in detail below.

1.1 Layer 102

When serving as a substrate, layer 102 provides dimensionally stable mechanical support to the printing member. The substrate should be strong, stable, and flexible. One or more surfaces (and, in some cases, bulk components) of the substrate may be hydrophilic. The topmost surface, however, is generally oleophilic. Suitable materials may be metal or polymeric in nature. As used herein, the term "substrate" refers generically to the ink-accepting layer beneath the radiation-sensitive layer 104, although the substrate may, in fact, include multiple layers (e.g., an oleophilic film laminated to an optional metal support, such as an aluminum sheet having a thickness of at least 0.001 inch, or an oleophilic coating over an optional paper support). Thus, a polymeric substrate may be a bulk polymer or polymer layer applied over a metal or paper support.

Various embodiments of the present invention utilize metal substrates, e.g., an anodized aluminum sheet; although such substrates have hydrophilic surfaces that make them suitable for wet plates, the surface is also oleophilic, making it suitable for the present usage. In one embodiment, substrate 102 is a 200 μm (0.008 inch) anodized aluminum sheet (1052 aluminum alloy, electrochemically etched and anodized to give an anodic layer with Ra values in the order of 0.300 μm).

Heat dissipation must be considered when using a metal substrate, since metal is such a good conductor of heat; if too much laser energy is lost into the substrate, the imaging layer will not ablate. One approach is to use a sufficiently thick imaging layer (e.g., 1.3 g/m$^2$ for an aluminum substrate, as compared with 0.5 g/m$^2$ with a polyester substrate). At sufficient thicknesses, heat remains concentrated within the upper region of the imaging layer and ablates only a fraction of the thickness; in effect, the remainder of the layer provides insulation against heat dissipation. So long as the imaging layer is oleophilic, it can serve as an ink receptor. Moreover, since the underlying metal substrate is also oleophilic, the imaging layer need not be particularly durable—i.e., it does not matter whether it wears away during use, since the underlying layer will provide the ink-accepting lithographic function. A sufficiently high laser power (and/or sufficiently slow imaging speeds) can facilitate use of a thinner imaging layer, since sufficient energy for ablation will be imparted notwithstanding dissipation of some laser energy into the metal substrate. Post-imaging cleaning procedures can be modified depending on the response of the imaging layer; for example, some implementations will require cleaning fully through to the substrate (even, in some cases, if ablation is confined to a small portion of the imaging-layer thickness), while other implementations will leave remnants of the imaging layer behind.

Substrate 102 desirably also desirably exhibits high scattering with respect to imaging radiation. This allows full utilization of the radiation transmitted through overlying layers, as the scattering causes back-reflection into layer 104 and consequent increases in thermal efficiency. Polymers suitable for use in substrates according to the invention include, but are not limited to, polyesters (e.g., polyethylene terephthalate and polyethylene naphthalate), polycarbonates, polyurethane, acrylic polymers, polyamide polymers, phenolic polymers, polysulfones, polystyrene, and cellulose acetate. A preferred polymeric substrate is polyethylene terephthalate film, such as the polyester films available from DuPont-Teijin Films, Hopewell, Va. under the trademarks MYLAR and MELINEX, for example. Also suitable are the white polyester products from DuPont-Teijin such as MELINEX 927W, 928W 329, 329S, 331. Suitable substrates include polyethylene terephthalate, polyethylene naphthalate and polyester laminated to an aluminum sheet. Substrates may be coated with a subbing layer to improve adhesion to subsequently applied layers.

For example, polymeric substrates can be coated with a hard polymer transition layer to improve the mechanical strength and durability of the substrate and/or to alter the hydrophilicity or oleophilicity of the surface of the substrate. Ultraviolet- or EB-cured acrylate coatings, for example, are suitable for this purpose. Polymeric substrates can have thicknesses ranging from about 50 μm to about 500 μm or more, depending on the specific printing member application. For printing members in the form of rolls, thicknesses of about 200 μm are preferred. For printing members that include transition layers, polymer substrates having thicknesses of about 50 μm to about 100 μm are preferred.

1.2 Layer 104

Layer 104 ablates in response to imaging radiation, typically near-IR radiation. In general, layer 104 has a cured resin phase consisting essentially of a melamine resin and a resole resin, the latter being present in an amount ranging from 0% to 28% by weight of dry film. A near-IR absorber—typically a dye—is dispersed within the cured resin phase.

The term "resole resin" refers to the reaction of phenol with an aldehyde (usually formaldehyde) under alkali conditions with an excess of formaldehyde. The molar ratio of phenol to aldehyde is typically 1:1.1 to 1:3, and the excess formaldehyde causes the resulting polymer to have many $CH_2OH$ (methylol) pendant groups. This distinguishes resoles from other phenolic resins (including phenol formaldehyde resins such as novolaks, which are prepared under acidic conditions with an excess of phenol rather than aldehyde).

Suitable melamine resins include water-free methylated, low-methylol, high-imino melamine materials, for example, CYMEL crosslinkers from Cytek Industries, Inc., especially CYMEL 323, CYMEL 325 and CYMEL 327. The CYMEL melamine cross-linkers have solution viscosity 1000 to 1600 centipoises at 23° C., especially 1100 to 1300 centipoises, and most especially 1100 centipoises. Melamine self-crosslinking or crosslinking with a resole resin, if present, may be facilitated by a sulfonic acid catalyst, typically a p-toluenesulfonic acid catalyst. The sulfonic acid catalyst is typically a p-toluenesulfonic acid catalyst and is desirably present in an amount ranging from 0.7 to 1.6% by weight of the dry film, preferably 0.7 to 1.4% and especially 1.0 to 1.4%.

Layer 104 desirably exhibits water compatibility following ablation. When layer 104 is only partially ablated, it is either (a) sufficiently water-compatible to be fully removed during cleaning, or (b) oleophilic if some of the layer remains even after cleaning. This layer should exhibit good adhesion to substrate 102, and resistance to age-related degradation is also desirable. Typically, layer 104 is cured and dried at 220 to 320° F., and especially 240 to 300° F. (i.e., approximately 104 to 160° C., especially 115 to 149° C.).

For proper printing performance following mechanical cleaning, imaging layers having dry coating weights from 0.3 to 2.5 g/m$^2$, and especially from about 0.5 g/m$^2$ to 1.5 g/m$^2$, are preferred. Because the imaging layer is oleophilic it need not be fully removed after machine cleaning.

In various embodiments, ablatability is achieved at a fluence of 195 mJ/cm$^2$ or less, and more preferably at a fluence of 210 mJ/cm$^2$ or less. The ablation threshold is dictated primarily by layer thickness and the loading level and efficiency of the absorber. In the embodiments described herein, the absorbing dye is present at a loading level ranging from 12 to 30% by weight of dry film.

1.3 Silicone Layer 106

The topmost layer participates in printing and provides the requisite lithographic affinity difference with respect to substrate 102; in particular, layer 106 is oleophobic and suitable for dry printing. In addition, the topmost layer 106 may help to control the imaging process by modifying the heat dissipation characteristics of the printing member at the air-imaging layer interface.

Typically, layer 106 is a silicone or fluoropolymer. Silicones are based on the repeating diorganosiloxane unit $(R_2SiO)_n$, where R is an organic radical or hydrogen and n denotes the number of units in the polymer chain. Fluorosilicone polymers are a particular type of silicone polymer wherein at least a portion of the R groups contain one or more fluorine atoms. The physical properties of a particular silicone polymer depend upon the length of its polymer chain, the nature of its R groups, and the terminal groups on the end of its polymer chain. Any suitable silicone polymer known in the art may be incorporated into or used for the surface layer. Silicone polymers are typically prepared by crosslinking (or "curing") diorganosiloxane units to form polymer chains. The resulting silicone polymers can be linear or branched. A number of curing techniques are well known in the art, including condensation curing, addition curing, moisture curing. In addition, silicone polymers can include one or more additives, such as adhesion modifiers, rheology modifiers, colorants, and radiation-absorbing pigments, for example. Other options include silicone acrylate monomers, i.e., modified silicone molecules that incorporate "free radical" reactive acrylate groups or "cationic acid" reactive epoxy groups along and/or at the ends of the silicone polymer backbone. These are cured by exposure to UV and electron radiation sources. This type of silicone polymer can also include additives such as adhesion promoters, acrylate diluents, and multifunctional acrylate monomer to promote abrasion resistance, for example.

The silicone layer may have a dry coating weight of, for example, 0.5 to 2.5 g/m$^2$, with the range 1 to 2.5 g/m$^2$ being particularly preferred for typical commercial applications.

1.4 Optional Secondary Imaging Layer 108

Figure 1B:
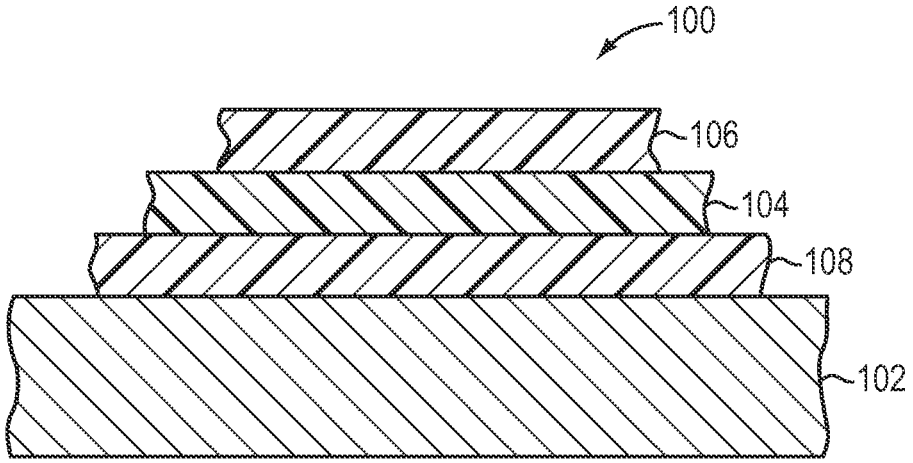

With reference to FIG. 1B, some embodiments 100' include an additional polymeric imaging layer 108 having an imaging pigment dispersed therein. Layer 108 can be any polymer capable of stably retaining, at the applied thickness, the IR-absorptive pigment dispersion (generally carbon black) adequate to cause ablation of the layer in response to an imaging pulse; and of exhibiting water compatibility following ablation. Furthermore, in embodiments where layer 108 is only partially ablated, it is either (a) sufficiently water-compatible to be fully removed during cleaning, or (b) oleophilic if some of layer remains even after cleaning. It is found that the carbon black enhances, or even confers, the desired water compatibility of layer 108 or the ablation debris thereof. Layer 108 should exhibit good adhesion to the overlying layer 104, and resistance to age-related degradation may also be considered.

In general, pigment loading levels are no greater than 20% or 25%, and the coating is applied at a dry weight of about 0.3 g/m$^2$. A typical composition for layer 108 includes or consists essentially of up to 25% carbon black, 60 to 90% resole resin (especially 70 to 80%), up to 20% melamine resin (usually about 10%), less than 5% catalyst and less than 2% surfactant/leveling agent.

2. Imaging of Printing Plates

Imaging of the printing member 100, 100' may take place directly on a press, or on a platemaker. In general, the imaging apparatus will include at least one laser device that emits in the region of maximum plate responsiveness, i.e., whose $\lambda_{max}$ closely approximates the wavelength region where the plate absorbs most strongly. Specifications for lasers that emit in the near-IR region are fully described in U.S. Pat. Nos. Re. 33,512 ("the '512 patent") and 5,385,092 ("the '092 patent"), the entire disclosures of which are hereby incorporated by reference. Lasers emitting in other regions of the electromagnetic spectrum are well-known to those skilled in the art.

Suitable imaging configurations are also set forth in detail in the '512 and '092 patents. Briefly, laser output can be provided directly to the plate surface via lenses or other beam-guiding components, or transmitted to the surface of a blank printing plate from a remotely sited laser using a fiber-optic cable. A controller and associated positioning hardware maintain the beam output at a precise orientation with respect to the plate surface, scan the output over the surface, and activate the laser at positions adjacent selected points or areas of the plate. The controller responds to incoming image signals corresponding to the original document or picture being copied onto the plate to produce a precise negative or positive image of that original. The image signals are stored as a bitmap data file on a computer. Such files may be generated by a raster image processor ("RIP") or other suitable means. For example, a RIP can accept input data in page-description language, which defines all of the features required to be transferred onto the printing plate, or as a combination of page-description language and one or more image data files. The bitmaps are constructed to define the hue of the color as well as screen frequencies and angles.

Other imaging systems, such as those involving light valving and similar arrangements, can also be employed; see, e.g., U.S. Pat. Nos. 4,577,932; 5,517,359; 5,802,034; and 5,861,992, the entire disclosures of which are hereby incorporated by reference. Moreover, it should also be noted that image dots may be applied in an adjacent or in an overlapping fashion. The imaging apparatus can be configured as a flatbed recorder or as a drum recorder, with the lithographic plate blank mounted to the interior or exterior cylindrical surface of the drum.

In the drum configuration, the requisite relative motion between the laser beam and the plate is achieved by rotating the drum (and the plate mounted thereon) about its axis and moving the beam parallel to the rotation axis, thereby scanning the plate circumferentially so the image "grows" in the axial direction. Alternatively, the beam can move parallel to the drum axis and, after each pass across the plate, increment angularly so that the image on the plate "grows" circumferentially. In both cases, after a complete scan by the beam, an image corresponding (positively or negatively) to the original document or picture will have been applied to the surface of the plate. In the flatbed configuration, the beam is drawn across either axis of the plate, and is indexed along the other axis after each pass. Of course, the requisite relative motion between the beam and the plate may be produced by movement of the plate rather than (or in addition to) movement of the beam.

Examples of useful imaging devices include models of the MAGNUS and TRENDSETTER imagesetters (available from Eastman Kodak Company) that utilize laser diodes emitting near-IR radiation at a wavelength of about 830 nm. Other suitable exposure units include the CRESCENT 42T Platesetter (operating at a wavelength of 1064 nm, available from Gerber Scientific, Chicago, Ill.) and the SCREEN PLATERITE 4300 series or 8600 series plate-setter (available from Screen, Chicago, Ill.).

Following imaging, the printing member is subjected to an aqueous liquid to remove debris where the printing member received imaging radiation, thereby creating an imagewise pattern on the printing member. The aqueous liquid may consist essentially of water, e.g., it may be plain tap water. Alternatively, the aqueous liquid may comprise water and a component that eases the removal of silicone and ablation debris, facilitating faster and more efficient cleaning. The aqueous liquid may include not more than 20% (or not more than 15%) by weight of an organic solvent, e.g., an alcohol, and the alcohol may be a glycol (e.g., propylene glycol), benzyl alcohol and/or phenoxyethanol. The aqueous liquid may comprise a surfactant and/or may be heated to a temperature greater than about 80° F.

In accordance with the present invention, machine cleaning takes advantage of the preferred imaging-layer coating weights. Preferred processing machines utilize warm water as a cleaning agent applied by spraying onto the plate (as opposed to immersion). Suitable examples include the Käonings Plate Washer, type KP 650/860 S-CH (Käonings GmbH, D-41751, Viersen, Germany) which has two rotary, oscillating brush rollers in the cleaning section), as well as the Käonings KTW-S and KTW-HS models, the AS-34 Plate Processor (NES Worldwide Inc., Westfield, Mass., which has three rotary, oscillating brush rollers in the cleaner section), the Presstek WPP85/SC850 Plate Washer (NES Worldwide Inc., which has two rotary brush rollers), the Haase MWP T10 (marks-3zet GmbH & Co, Mäulheim, Germany), the Krause BLUEFIN WATERLESS (Krause-Biagosch GmbH, Bielefeld, Germany), and the Techno-Grafica PPW-HS (Techno-Grafica GmbH, Kampfelbach, Germany). Using the Konings Plate Washer, printing members may be cleaned with a sprayed-on, warm (32° C.) aqueous liquid, with the help of the two roller brushes. The aqueous liquid may consist essentially of water—for example, it may be plain tap water. Alternatively, the aqueous liquid may comprise or consist essentially of water and a component that eases the removal of silicone. The aqueous liquid may include not more than 20% by weight of an organic solvent, e.g., an alcohol such as a glycol (e.g., propylene glycol), benzyl alcohol and/or phenoxyethanol. The aqueous liquid may comprise a surfactant. The aqueous liquid may be heated to a temperature greater than about 80° F.

EXAMPLES

Comparative Example C1

This example describes a negative-working waterless printing plate that comprises an oleophobic silicone layer disposed on an imaging layer composed of infrared absorbing dye and polymer, which is itself disposed on an aluminum substrate. A preferred substrate is a 200 μm (8 mil) anodized aluminum sheet, as used, for example, in the AURORA EXP plate (1052 aluminum alloy, electrochemically etched and anodized to give an anodic layer with Ra values in the order of 0.300 μm), supplied by Presstek, Inc., Hudson, N.H.

The formulation given in the following table was used for the infrared absorbing imaging layer. This formulation yields a dry imaging layer containing a catalyst concentration of 1.4% by weight.

| Components | Parts by Weight Example C1 |
|---|---|
| Cymel 385 Resin | 5.033 |
| S0094 NIR Dye | 1.800 |
| Victoria Pure Blue BO ZF | 0.176 |
| Cycat 4040 | 0.101 |
| BYK 307 | 0.090 |
| Dowanol PM | 92.800 |

CYMEL 385 is a methylated, low methylol and high imino, melamine-formaldehyde resin supplied by Cytek Industries, Inc. (West Paterson, N.J.) as an 80% solids mix in water. This resin has a reported viscosity in the range of 1000 cps to 1400 cps, and monomer content between 58% and 63%. CYCAT 4040 is a general purpose, p-toluenesulfonic acid catalyst supplied as a 40% solution in isopropanol by Cytek Industries, Inc. BYK 307 is a polyether modified polydimethylsiloxane surfactant supplied by BYK Chemie (Wallingford, Conn.). The solvent, DOWANOL PM, is propylene glycol methyl ether available from the Dow Chemical Company (Midland, Mich.). 50094 is a cyanine near-IR dye manufactured by FEW Chemicals GmbH (Bitterfeld-Wolfen, Germany), which has a reported coefficient of absorption of $2.4\times10^5$ L/mol-cm at the maximum absorption wavelength, $\lambda_{max}$, of about 813 nm (measured in methyl ethyl ketone (MEK) solution). This dye displays very good solubility in DOWANOL PM. Victoria Blue Pure BO ZF is a visible dye that is added to the formulation to produce plates with enhanced image/non-image contrast. The dye is manufactured by Keystone Aniline Corporation (Chicago, Ill.) and supplied as 100% solid.

The coating solution was applied to the aluminum substrate using a wire-wound metering rod and then was dried and cured at 138° C. (temperature set on the oven dial) to produce a dried coating of coat weight of 1.3 g/m$^2$. The coat weight was measured gravimetrically on samples prepared with a formulation without catalyst. Drying and curing were carried out on a belt conveyor oven, SPC Mini EV 48/121, manufactured by Wisconsin Oven Corporation (East Troy, Wis.). The conveyor was operated at a speed of 3.2 feet/minute (which gives a dwell time of about 40 seconds in the air-heated zone of the oven.).

The oleophobic silicone top layer for the example was subsequently disposed on the imaging layer using the formulation given below. The silicone layer consists essentially of a highly crosslinked network structure produced via the addition or hydrosilylation reaction between the vinyl groups (SiVi) of vinyl-terminated functional silicones and the silyl (SiH) groups of trimethylsiloxy-terminated poly(hydrogen methyl siloxane) crosslinker, in the presence of a Pt catalyst complex and an inhibitor.

| Component | Parts by Weight |
|---|---|
| PLY-3 7500P | 12.40 |
| DC Syl Off 7367 Crosslinker | 0.53 |
| CPC 072 Pt Catalyst | 0.17 |
| Heptane | 86.9 |

The PLY-3 7500P is an end-terminated vinyl functional silicone resin, with average molecular weight 62,700 g/mol, supplied by Nusil Silicone Technologies (Charlotte, N.C.). DC SYL OFF 7367 is a trimethylsiloxy-terminated poly(hydrogen methylsiloxane) crosslinker manufactured by Dow Corning Silicones (Midland, Mich.); it is supplied as a 100% solids solution containing about 30% of 1-ethynylcyclohexane [$CH{=}CH{-}CH(CH_2)_5$], which functions as catalyst inhibitor. CPC 072 is a 1,3 diethyenyl-1,1,3,3-tetramethyldisiloxane Pt-complex catalyst manufactured by Umicore Precious Metals (South Plainfield, N.J.), and is supplied as a 3% xylene solution. The formulation solvent, heptane, is supplied by Houghton Chemicals (Allston, Mass.).

The silicone formulation was applied to the imaging layer with a wire-wound rod, then dried and cured at 148° C. (temperature set on the oven dial) in the same oven described above to produce uniform silicone coatings of 1.9 g/m$^2$, as verified by gravimetric measurements. Samples were assessed for durability and environmental stability by conducting an MEK rub test of fresh plates stored at ambient conditions and also of plates aged in an environmental chamber at high temperature and humidity (80° C., 75% R.H., 18 hours). In this test, MEK double rubs are applied in a reciprocating mode with a five-pound load on plate samples about 20 cm in length. The cycle is repeated to the point of visual evidence failure: marring of the surface or loss of silicone adhesion. To pass this test, the plate examples should resist more than ten cycles of the test without showing signs of failure.

Printing plate precursors (i.e., cured but unimaged plates) were imaged on a KODAK TRENDSETTER image setter, available from Eastman Kodak (Rochester, N.Y.), operating at a wavelength of 830 nm. An imaging file including a solid screen and high-resolution patterns (3×3 and 2×2 patterns) was run at increasing power levels at a constant drum speed of 150 rpm. The output power of the laser was varied from 6 W up to 13 W at increments of one watt, which corresponds to IR imaging radiation having fluences of 98, 114, 130, 147, 163, 179, 195, up to 212 mJ/cm$^2$ at the plane of the plate, respectively.

The final printing members were then produced by cleaning the imaged samples to remove the loosened silicone debris left on the exposed regions of the plate. This was done by machine-cleaning using a KP 650/860 S-CH plate washer from Konings (Viersen, Germany) in which the plates are cleaned with warm water (32° C.) with the help of two roller brushes which rotate and oscillate continuously.

Plate sensitivity and cleanability were ascertained from print sheets obtained by running the printing plates on a Heidelberg GTO press using black ink (Aqualess Ultra Black MZ waterless ink, Toyo Ink America LLC, Addison, Ill.) and uncoated stock (Williamsburg Plus Offset Smooth, 60 lb white, item number: 05327, International Paper, Memphis, Tenn.). Plates were run for at least 200 impressions. The sensitivity of each plate is defined as the power required to yield print sheets with well-defined high-resolution patterns (2×2 and 3×3). The following table details the MEK resistance and imaging performance of Example C1.

| | MEK Rubs | | Imaging Sensitivity (mJ/cm$^2$) | |
|---|---|---|---|---|
| Example | Fresh | Aged | 3 × 3 | 2 × 2 |
| Example C1 | 30-40 | 0-3 | 147 | 163-179 |

The fresh plate samples, indeed the fresh plate samples of all the examples herein, exhibit very good MEK resistance. But after aging, the MEK resistance of this example is drastically degraded.

Comparative Example C2

This example is similar to Example C1 but features an imaging layer that utilizes a different water-based melamine-formaldehyde resin (CYMEL 328 resin). This formulation yields a dried imaging layer containing 1.4% catalyst by weight.

| Components | Parts by Weight |
|---|---|
| Cymel 328 Resin | 5.033 |
| S0094 NIR Dye | 1.800 |
| Victoria Pure Blue BO ZF | 0.176 |
| Cycat 4040 | 0.101 |
| BYK 307 | 0.090 |
| Dowanol PM | 92.800 |

CYMEL 328 is a methylated, low methylol and high imino, melamine-formaldehyde resin supplied as an 85% solids mix in water by Cytek Industries, Inc. (West Paterson, N.J.). The reported viscosity is between 1000 cps to 3000 cps, and monomer content of about 55%. The melamine-formaldehyde and silicone layers were consecutively applied to the same aluminum substrate, and subsequently evaluated as described above for Example C1.

The resulting plate precursor performs very similarly to Example C1. The fresh plate displays very good MEK resistance (20-50 cycles), but this is completely lost after aging (no MEK rubs were tolerated). The imaging sensitivity of the plate is also comparable to that of Example C1, requiring fluences of 147 mJ/cm$^2$ and 179-195 mJ/cm$^2$, respectively, to produce well-defined 3×3 and 2×2 high-resolution patterns on the printing sheets.

Examples 1 and 2

These examples are of similar composition to Example C1, but the water-based CYMEL 385 resin was replaced with alternative melamine-formaldehyde resins supplied in an organic solvent. Example 1 uses CYMEL 323 supplied as an 80% total solids mix in isobutanol that has reported viscosity between 2500 cps to 7500 cps, and monomer content of about 58%. Example 2 uses CYMEL 325 supplied in isobutanol as a mix with about 85% of total solids, with viscosity ranging from 2500 cps to 4500 cps, and monomer content of about 46%. Both are methylated, low methylol and high imino, melamine-formaldehyde resins supplied by Cytek Industries, Inc. (West Paterson, N.J.).

Precursors were built with dry imaging layers having catalyst concentration of 1.4% by weight, as in Example C1. They were applied to the same aluminum substrate and coated with silicone as described in previous examples.

| Components | Parts by Weight |
|---|---|
| Cymel Resins supplied in isobutanol | 5.033 |
| S0094 NIR Dye | 1.800 |
| Victoria Pure Blue BO ZF | 0.176 |
| Cycat 4040 | 0.101 |
| BYK 307 | 0.090 |
| Dowanol PM | 92.800 |

The properties of the resulting precursors were evaluated according to the procedures given above. The samples made with solvent-based melamine-formaldehyde resins exhibited better environmental stability than those using water-based CYMEL resins. Note that the plates display imaging sensitivity comparable to that of Examples C1 and C3 made with similar catalysts levels. Printing members made using water-free melamine formaldehyde resins exhibited good environmental stability and imaging sensitivity.

The printing plates of these examples were mounted on the GTO Heidelberg press using the same paper and ink as in Example C1. The plates ran successfully for more than 500 impressions.

| | MEK Rubs | | Imaging Sensitivity (mJ/cm$^2$) | |
|---|---|---|---|---|
| Example | Fresh | Aged | 3 × 3 | 2 × 2 |
| Example 1 | 20-50 | 20-50 | 147 | 163-179 |
| Example 2 | 40-50 | 20 | 147 | 179 |

Comparative Examples C3-05 and Examples 3-5

Here a series of waterless printing-plate precursors were made with imaging layers based on Cymel 323 resin and containing catalyst concentrations ranging from 0.5% to 3% by weight in the dry coatings. The layers were applied to the same aluminum substrate and subsequently coated with the silicone layer as described previously.

| Components | Parts by Weight | | | | | |
|---|---|---|---|---|---|---|
| | Example C3 | Example 3 | Example 4 | Example 5 | Example C4 | Example C5 |
| Cymel 323 Resin supplied in isobutanol | 5.099 | 5.084 | 5.062 | 5.047 | 5.004 | 4.919 |
| S0094 NIR Dye | 1.800 | 1.800 | 1.800 | 1.800 | 1.800 | 1.800 |
| Victoria Pure Blue BO ZF | 0.176 | 0.176 | 0.176 | 0.176 | 0.176 | 0.176 |
| Cycat 4040 | 0.036 | 0.051 | 0.072 | 0.087 | 0.130 | 0.215 |
| BYK 307 | 0.090 | 0.090 | 0.090 | 0.090 | 0.090 | 0.090 |
| Dowanol PM | 92.800 | 92.800 | 92.800 | 92.800 | 92.800 | 92.800 |

Durability and aging stability determination were carried out using the procedures described previously. The results presented in the table below show that solvent resistance of the samples is greatly dependent on the catalyst amount used in the imaging layer. Acceptable durability is achieved with a minimum concentration of 0.7% catalyst by weight. Increasing catalyst levels up to 3% improves solvent resistance of fresh plate samples. Environmental stability, however, is diminished as the catalyst level is increased to 1.8% and beyond by weight. Examples C4 and C5, with imaging layers using the highest levels of catalyst, do not pass the accelerated aging test (tolerating <10 cycles in the MEK rub test).

| Example | Catalyst % by weight in dry coating | MEK Rubs | |
|---|---|---|---|
| | | Fresh | Aged |
| Example C3 | 0.5 | 0-5 | 5-10 |
| Example 3 | 0.7 | 15-20 | 10-20 |
| Example 4 | 1.0 | 15-30 | 20-30 |
| Example 5 | 1.2 | 25-35 | 20-30 |
| Example C4 | 1.8 | 20-40 | 2-5 |
| Example C5 | 3.0 | 20-50 | 0 |

The examples show that the presence of water, and also the concentration of catalyst used in the imaging layer, affect the environmental stability of the printing precursors. Plates with acceptable stability are produced with imaging-layer formulations using water-free melamine formaldehyde resins and catalyst levels higher than 0.7% but lower than 1.8% by weight in the dry coating.

Example 6

This example describes a negative-working waterless printing plate comprising an oleophobic silicone layer disposed on an imaging layer including an IR-absorbing dye and a polymer, and which is itself disposed on a polyester substrate. A preferred substrate is a 175 μm white polyester film sold by DuPont Teijin Films (Hopewell, Va.) under the name MELINEX 928. This is an opaque white film pretreated on one side to promote adhesion to solvent-based coatings. The formulation used for the IR-absorbing imaging layer of the plate precursor is given in the table below.

| Components | Parts by Weight |
|---|---|
| Cymel 323 Resin | 3.078 |
| S0094 NIR Dye | 1.087 |

-continued

| Components | Parts by Weight |
|---|---|
| Victoria Pure Blue BO ZF | 0.104 |
| Cycat 4040 | 0.052 |
| BYK 307 | 0.028 |
| Dowanol PM | 95.651 |

The wet coating was dried and cured at 127° C. in the oven described above to produce a dried coating of coat weight of 0.5 g/m$^2$, containing 1.2 parts per hundred (by weight) of the CYCAT 4040 catalyst. Subsequently, a silicone layer of the same composition and thickness as in previous examples was applied to the dried/cured imaging layer, and was itself dried cured at 160° C.

It was verified that the plate precursor of this example, built on the polyester substrate, displays good environmental stability; the fresh plate shows good MEK resistance (15-20 cycles of the test), which is slightly lowered after aging (about 15 cycles of the test).

Although the present invention has been described with reference to specific details, it is not intended that such details should be regarded as limitations upon the scope of the invention, except as and to the extent that they are included in the accompanying claims.

What is claimed is:

1. A method of making an ablation-type printing member, the method comprising the steps of:

(a) providing a substrate having an oleophilic surface;

(b) coating, over the substrate, solution comprising (A) melamine component substantially free of water and a resole component, the resole component being present in an amount ranging from 0% to 28% by weight of dry film, (B) a near-IR absorber dispersed within the crosslinked polymer network, and (C) a sulfonic acid catalyst dispersed within the crosslinked polymer network and being present in an amount ranging from 0.7% to 1.6% by weight of dry film;

(c) curing the solution to produce a dry film having a single crosslinked polymer network consisting essentially of the melamine component and the resole component;

(d) following step (c), coating, over the cured imaging layer, an oleophobic polymer composition; and (e) curing the oleophobic polymer composition.

2. The method of claim 1 wherein the melamine resin is provided in an organic solvent.

3. The method of claim 2 wherein the organic solvent is isobutanol.

4. The method of claim 1 wherein the sulfonic acid catalyst is present in an amount ranging from 1% to 1.4% by weight of dry film.

5. The method of claim 1 wherein the substrate is an aluminum sheet.

6. The method of claim 1, wherein the imaging layer contains no resole resin.

7. The method of claim 1, wherein the near-IR absorber consists essentially of a dye.

8. The method of claim 1, wherein the near-IR absorber constitutes from 12% to 30% of the imaging layer by weight of dry film.

9. The method of claim 8, wherein the near-IR absorber constitutes from 25% to 30% of the imaging layer by weight of dry film.

10. The method of claim 1, wherein the melamine component is a methylated, low-methylol, high-imino melamine.

11. The method of claim 1, wherein the imaging layer has a dry coating weight of approximately 0.5 $g/m^2$ to approximately 1.5 $g/m^2$.

12. A method of using an ablation-type printing member comprising (i) an oleophilic substrate, (ii) over and in contact with the substrate, an imaging layer comprising a crosslinked polymer network formed from the cured product of a solution consisting essentially of a melamine component substantially free of water and a resole component, the resole component being present in an amount ranging from 0% to 28% by weight of dry film, wherein the crosslinked polymer network is the only crosslinked polymer network in the imaging layer, a near-IR absorber dispersed within the crosslinked polymer network, and a sulfonic acid catalyst dispersed within the crosslinked polymer network and being present in an amount ranging from 0.7% to 1.6% by weight of dry film, and (iii) over and in contact with the imaging layer, a cured oleophobic polymer composition, the method comprising the steps of:

a) storing the printing member without use for at least 24 months under conditions including a temperature ranging from 60 to 80 ° F. and a relative humidity of 40 to 60%;

b) exposing the printing member to imaging radiation having a fluence of no more than 190 $mJ/cm^2$ in an imagewise pattern, the imaging radiation at least partially ablating the imaging layer where exposed;

c) removing imaging debris from the printing member; and d) transferring ink to the printing member and thereafter from the printing member to a recording medium at least 500 times.

13. The method of claim 12 wherein the printing member is stored for at least 30 months.

14. The method of claim 13 wherein the printing member is stored for at least 36 months.

15. The method of claim 14 wherein the printing member is stored for at least five years.

16. The method of claim 12 wherein the substrate is an aluminum sheet.

* * * * *